US008057015B2

(12) United States Patent
Oguchi

(10) Patent No.: US 8,057,015 B2
(45) Date of Patent: Nov. 15, 2011

(54) LIQUID EJECTING HEAD UNIT AND LIQUID EJECTING APPARATUS

(75) Inventor: Satoshi Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 338 days.

(21) Appl. No.: 12/473,160

(22) Filed: May 27, 2009

(65) Prior Publication Data

US 2009/0295867 A1 Dec. 3, 2009

(30) Foreign Application Priority Data

May 27, 2008 (JP) ..... 2008-138772
Feb. 20, 2009 (JP) ..... 2009-038688

(51) Int. Cl.
*B41J 2/14* (2006.01)

(52) U.S. Cl. ..... 347/50

(58) Field of Classification Search ..... 347/40, 347/43, 50, 58, 64, 65
See application file for complete search history.

(56) References Cited

FOREIGN PATENT DOCUMENTS

| | | | |
|---|---|---|---|
| JP | 05-057965 | A | 3/1993 |
| JP | 10-157120 | A | 6/1998 |
| JP | 10-217468 | A | 8/1998 |
| JP | 2000-025207 | A | 1/2000 |
| JP | 2007-237446 | A | 9/2007 |

*Primary Examiner* — Lamson Nguyen
(74) *Attorney, Agent, or Firm* — Kilpatrick Townsend & Stockton LLP

(57) ABSTRACT

A liquid ejecting head unit including a plurality of liquid ejecting heads is disclosed. A platform on which the plurality of the liquid ejecting heads are mounted in a staggered arrangement in the first direction, each liquid ejecting head being partially adjacent to each in a second direction, which is orthogonal to first direction. A common trunk passage communicates with the liquid passage ports. A plurality of branch passages communicates with the trunk passage. A plurality of branch circuit wiring sections connects to connectors of the liquid ejecting heads. The plurality of liquid ejecting heads are mounted such that liquid passage ports of each partially adjacent liquid ejecting head are not adjacent to each other in a second direction, and such that the connectors of each partially adjacent liquid ejecting head are not adjacent to each other in the second direction.

20 Claims, 8 Drawing Sheets

LIQUID EJECTING HEAD UNIT AND LIQUID EJECTING APPARATUS

This application claims priority to Japanese Patent Application No. 2008-138772, filed May 27, 2008, and Japanese Patent Application No. 2009-038688, filed Feb. 20, 2009. The entire disclosures of the aforementioned applications are incorporated by reference herein.

BACKGROUND OF THE INVENTION

The present invention relates to a liquid ejecting head unit and a liquid ejecting apparatus, in which a plurality of liquid ejecting heads are mounted on a platform, the liquid ejecting heads ejecting liquid from nozzle openings.

A liquid ejecting apparatus represented by an ink jet recording apparatus, such as an ink jet printer or plotter, includes a liquid ejecting head unit (hereinafter, also referred to as head unit) in which a plurality of liquid ejecting heads are mounted, the liquid ejecting heads being capable of ejecting liquid, e.g., ink, reserved in a cartridge or a tank, as liquid droplets.

The plurality of liquid ejecting heads are mounted on a platform, which is a common holding member. The plurality of liquid ejecting heads are arranged such that nozzle arrays, each of which has nozzle openings arranged in a line, of the liquid ejecting heads are continuously arranged in an arrangement direction of the nozzle openings (for example, see JP-A-5-57965 and JP-A-2000-25207).

However, when the plurality of liquid ejecting heads are mounted on the platform, supply pipes connected to liquid passage ports of the plurality of liquid ejecting heads interfere with circuit substrates connected to connectors of the liquid ejecting heads. Piping of the supply pipes and wiring of the circuit substrates may become complicated, resulting in increase in size of the liquid ejecting head unit.

Also, when the piping of the supply pipes and the wiring of the circuit substrates become complicated, working efficiency of attachment of the supply pipes and the circuit substrates becomes low. The attachment time may be long and an attachment error likely occurs.

A liquid ejecting head unit which ejects liquid other than ink may involve similar disadvantages.

BRIEF SUMMARY OF THE INVENTION

Some aspects of the invention provide a liquid ejecting head unit and a liquid ejecting apparatus which attains reduction in size and facilitates assembling by simplifying piping and wiring.

According to an embodiment of the invention, a liquid ejecting head unit includes a liquid ejecting head, a platform, a common trunk passage, individual branch passages, and branch circuit wiring sections. The liquid ejecting head includes a nozzle array in which a plurality of nozzle openings are arranged in a line, a liquid passage port whose inner passage is open and to which an external passage is connected, and a connector to which an electric signal is supplied from the outside. A plurality of the liquid ejecting heads are mounted on the platform in an arrangement direction of the nozzle openings and a direction orthogonal to the arrangement direction of the nozzle openings. The common trunk passage communicates with a plurality of the liquid passage ports of the plurality of liquid ejecting heads and extends in a first direction. The individual branch passages communicate with the trunk passage and respectively communicate with the liquid passage ports of the liquid ejecting heads. The branch circuit wiring sections are connected to a plurality of the connectors of the liquid ejecting heads, the branch circuit wiring sections supplying electric signals to the liquid ejecting heads. The liquid ejecting heads include a first liquid ejecting head and a second liquid ejecting head closest to the first liquid ejecting head from among the liquid ejecting heads whose projections are overlapped with a projection of the first liquid ejecting head in a second direction orthogonal to the first direction. A projection of the liquid passage port of the first liquid ejecting head is not overlapped with a projection of the liquid passage port of the corresponding second liquid ejecting head in the second direction. A projection of the connector of the first liquid ejecting head is not overlapped with a projection of the connector of the corresponding second liquid ejecting head in the second direction.

In one aspect, regarding the first and second liquid ejecting heads adjacent to each other in the second direction, the projections of the fluid passage ports are not overlapped with each other in the second direction, and the projections of the connectors are not overlapped with each other in the second direction. Accordingly, when the branch passages, which connect the trunk passage with the liquid passage ports, and the branch circuit wiring sections are connected to the liquid ejecting heads and the trunk passage in the second direction, interference among the plurality of branch passages, interference among the plurality of branch circuit wiring sections, and interference between the branch passage and the branch circuit wiring section can be prevented. Thus, lead arrangement of the branch passages and the branch circuit wiring sections can be simplified, thereby reducing the attachment time and preventing erroneous connection from occurring.

In another aspect, when projection is performed in the second direction, the liquid passage port of the first liquid ejecting head is not overlapped with the connector of the corresponding second liquid ejecting head. Accordingly, when the branch passages and the branch circuit wiring sections are connected to the liquid ejecting heads and the trunk passage in the second direction, interference among the plurality of branch passages, interference among the plurality of branch circuit wiring sections, and interference between the branch passage and the branch circuit wiring section can be prevented.

In yet another aspect, when projection is performed in the second direction, the liquid passage port of the first liquid ejecting head may be located between the liquid passage port and the connector of the corresponding second liquid ejecting head. Accordingly, when the branch passages and the branch circuit wiring sections are connected to the liquid ejecting heads and the trunk passage in the second direction, interference among the plurality of branch passages, interference among the plurality of branch circuit wiring sections, and interference between the branch passage and the branch circuit wiring section can be prevented.

In yet another aspect, a common trunk circuit substrate may further be provided at a position opposite to the platform with respect to the trunk passage, the trunk circuit substrate supplying the electric signals to the branch circuit wiring sections. With the arrangement, the common trunk circuit substrate is located at the position farthest from the ejecting surface of the liquid ejecting head. Mists, which are generated upon ink ejection, can be prevented from adhering to the trunk circuit substrate.

In yet another aspect, the liquid passage port may be arranged within a length of the nozzle array. Accordingly, merely by arranging the plurality of liquid ejecting heads such that the nozzle arrays are continuously arranged in the first direction, the liquid passage ports and the connector of the one liquid ejecting head can be easily arranged at positions different in the first direction from the positions of the liquid passage ports and the connector of the other liquid ejecting head being adjacent to the one liquid ejecting head in the second direction.

In yet another aspect, the connector and the liquid passage port may be arranged to be overlapped with the nozzle array in a vertical direction of a nozzle surface. Accordingly, the head can be reduced in size.

In yet another aspect, the liquid passage port may be arranged outside a length of the nozzle array. Accordingly, the liquid passage ports and the connector of the one liquid ejecting head can be easily arranged at positions different in the first direction from the positions of the liquid passage ports and the connector of the other liquid ejecting head being adjacent to the one liquid ejecting head in the second direction.

In yet another aspect, the connector and the plurality of liquid passage ports may be arranged in a line in the first direction. Accordingly, when the branch passages and the branch circuit wiring sections are connected to the liquid ejecting heads, interference among the plurality of branch passages, interference among the plurality of branch circuit wiring sections, and interference between the branch passage and the branch circuit wiring section can be prevented.

In yet another aspect, the trunk passage may extend in the first direction and may be connected to the liquid passage ports of the plurality of liquid ejecting heads arranged in the first direction. Accordingly, the trunk passage can easily communicate with the plurality of liquid ejecting heads.

In yet another aspect, the liquid ejecting head may include a plurality of liquid supply port. Also, at least one of the plurality of liquid passage ports serves as the liquid supply port for supplying liquid to a passage in the liquid ejecting head, and the other liquid passage ports serve as the liquid supply port or a liquid discharge port for discharging liquid to the outside from the passage in the liquid ejecting head. Accordingly, the trunk passage supplies liquid to the plurality of liquid ejecting heads and discharges liquid in the liquid ejecting heads to the trunk passage. Thus, circulating flow of the liquid can be formed in the liquid ejecting head. This may allow usage of liquid which is necessary to circulate.

According to another embodiment of the invention, a liquid ejecting apparatus includes the liquid ejecting head unit according to the above-described aspect. Liquid is ejected from the nozzle openings.

With this embodiment, a liquid ejecting apparatus reduced in size can be attained.

DETAILED DESCRIPTION OF THE INVENTION

Embodiments of the invention will be described below in detail.

Figure 1:
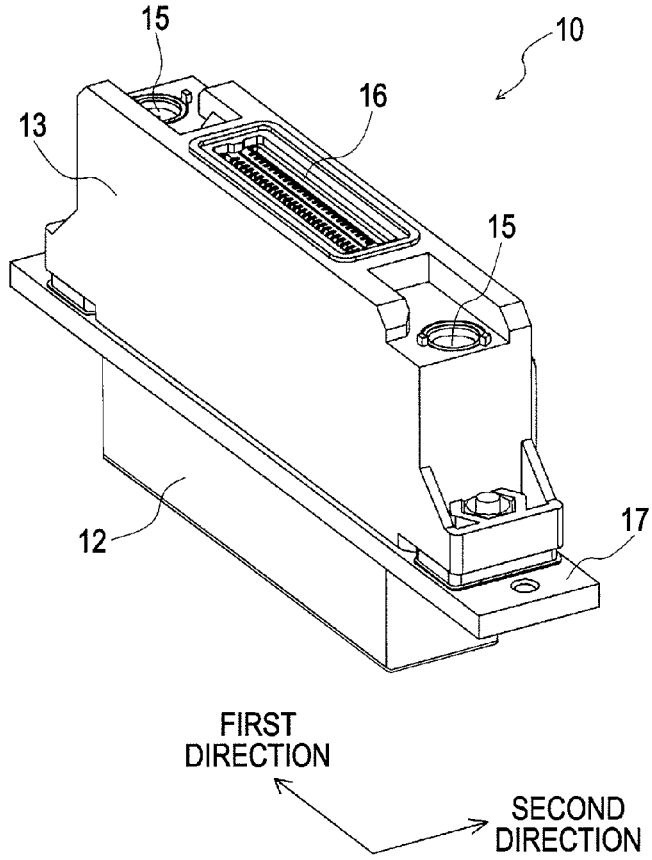
FIG. 1 is a perspective view showing a recording head according to a first embodiment of the invention.
Figure 2:
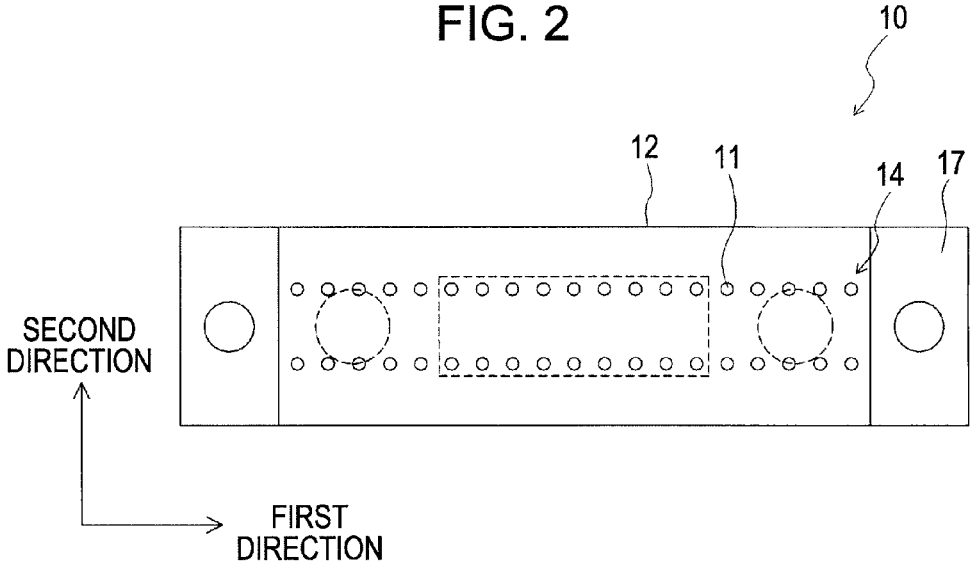
FIG. 2 is a plan view showing the recording head according to the first embodiment of the invention.

FIG. 1 is a perspective view showing an ink jet recording head, which is an example of a liquid ejecting head according to a first embodiment of the invention. FIG. 2 is a plan view showing the ink jet recording head.

Referring to the drawings, an ink jet recording head 10 (hereinafter, also referred to as head) according to this embodiment includes a head body 12 having nozzle openings 11 in an end surface, and a passage member 13 fixed to a surface of the head body 12 opposite to the surface with the nozzle openings 11.

The head body 12 has nozzle arrays 14 each of which has the nozzle openings 11 arranged in a line. The number of nozzle arrays 14 is not particularly limited. For example, a single nozzle array 14 or a plurality of nozzle arrays 14 including two or more arrays may be provided. In this embodiment, a single head body 12 has two nozzle arrays 14. Here, in this embodiment, a first direction represents a direction in which the nozzle openings 11 are arranged in a line in the nozzle array 14, and a second direction represents a direction orthogonal to the first direction. Accordingly, the two nozzle arrays 14 are arranged parallel along the second direction.

Though not shown, the inside of the head body 12 contains a pressure generating chamber which defines a part of a passage communicating with the nozzle opening 11, and a pressure generating portion which causes the pressure generating chamber to generate a pressure change to eject ink from the nozzle opening 11.

The pressure generating portion is not particularly limited, and may have, for example, a structure using a piezoelectric element in which a piezoelectric material having an electromechanical transduction function is arranged between two electrodes; a structure in which a heating element is arranged in a pressure generating chamber, the heating element generating heat to produce bubbles, droplets being ejected from the nozzle opening 11 by the produced bubbles; or a structure in which static electricity is generated between a vibration plate and an electrode, electrostatic force deforming the vibration plate, droplets being ejected from the nozzle openings 11.

The passage member 13 is fixed to the surface of the head body 12 opposite to the surface with the nozzle openings 11. The passage member 13 supplies ink from the outside to the head body 12, and/or discharges ink to the outside from the head body 12.

A liquid passage port 15 and a connector 16 are provided at a surface of the passage member 13 opposite to the surface thereof fixed to the head body 12. The liquid passage port 15 connects to an inside passage, and allows an outside passage to be connected thereto. The connector 16 receives an electric signal such as an outside printing signal.

In this embodiment, two liquid passage ports 15 are provided. The two liquid passage ports 15 and the connector 16 are arranged in the first direction which is an arrangement direction of the nozzle openings 11 in the nozzle array 14. In particular, in this embodiment, the connector 16 is provided at a center portion of the nozzle arrays 14 (i.e., a center portion of the head 10), and the liquid passage ports 15 are provided on both sides of the connector 16 one by one (the number is two in total). Hence, a large amount of liquid can be supplied to or discharged from the head body 12 without increasing the width of the head body 12 in the second direction, as compared with a case in which a liquid passage port 15 is provided only on one side of the connector 16 in the first direction.

The two liquid passage ports 15 and the connector 16 are arranged within a length of the nozzle arrays 14, or such that the liquid passage ports 15 and the connector 16 are overlapped with the nozzle arrays 14 in a plan view (i.e., when viewed from the nozzle arrays 14 or the liquid passage ports 15). At least one of the two liquid passage ports 15 provided at the passage member 13 functions as a liquid supply port for supplying liquid from the outside to the inside of the head 10. In other words, one of the two liquid passage ports 15 may function as a liquid supply port and the other liquid passage port 15 may function as a liquid discharge port for discharging liquid in the head 10 to the outside. Alternatively, both two liquid passage ports 15 may function as liquid supply ports. For example, when both the two liquid passage ports 15 function as the liquid supply ports, a passage in the head 10 may be configured such that the two liquid passage ports 15 respectively communicate with the nozzle arrays 14. For another example, when two liquid passage ports 15 respectively function as the liquid supply port and the liquid discharge port, a passage in the head 10 may be configured such that liquid is supplied to both the two nozzle arrays 14 from the liquid supply port, and liquid is discharged from both the two nozzle arrays 14 through the liquid discharge port.

Of course, the number of liquid passage ports 15 and the number of nozzle arrays 14 are not limited to those described above. Also, the assignment of the functions as the liquid supply port and the liquid discharge port to the liquid passage ports 15 are not limited to those described above.

Flange portions 17 are provided at both side surfaces of the head 10 in the first direction. The flange portions 17 protrude outward. The flange portions 17 are fixed to the platform 20 (described later in detail).

Figure 3:
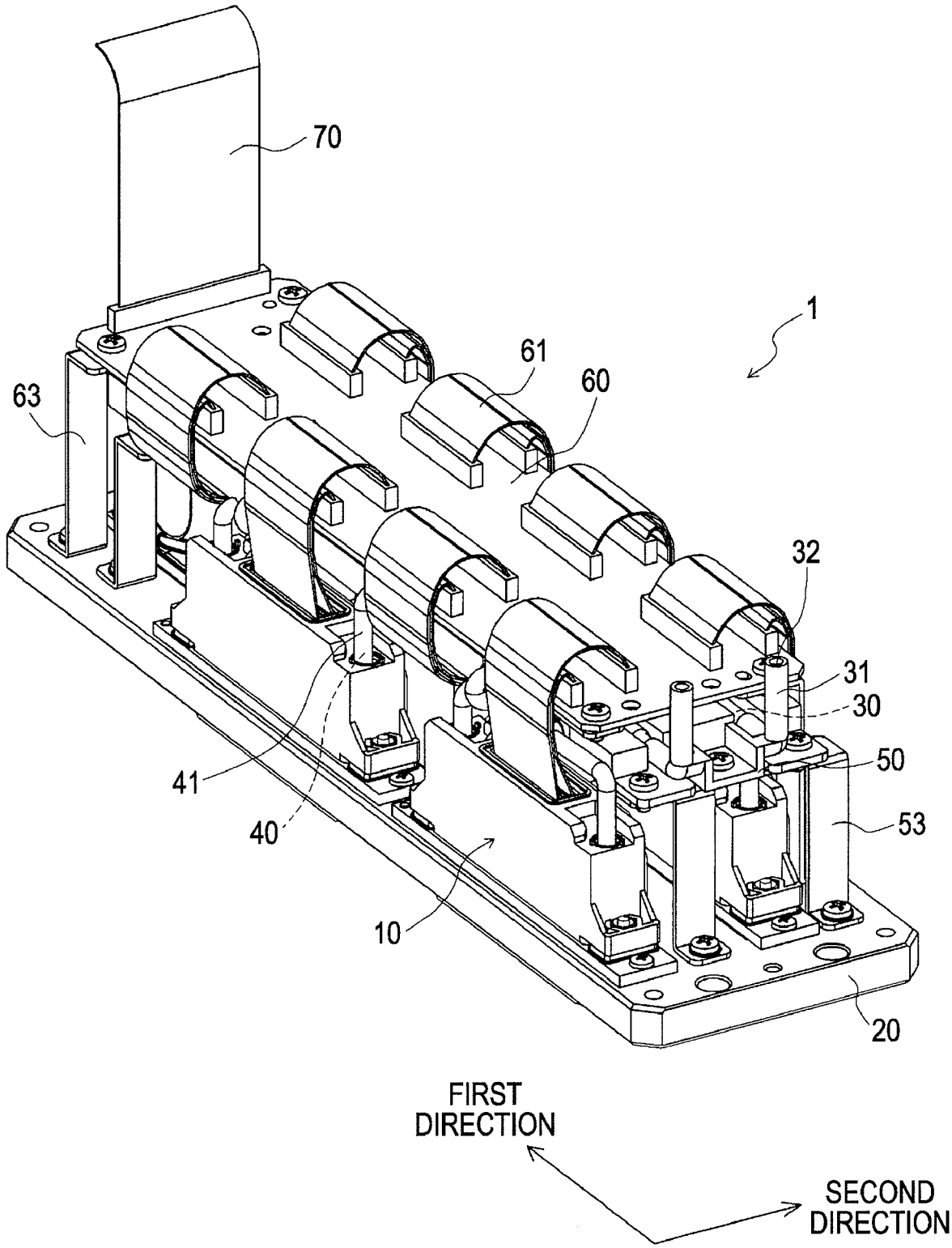
FIG. 3 is a perspective view showing a head unit according to the first embodiment of the invention.
Figure 4:
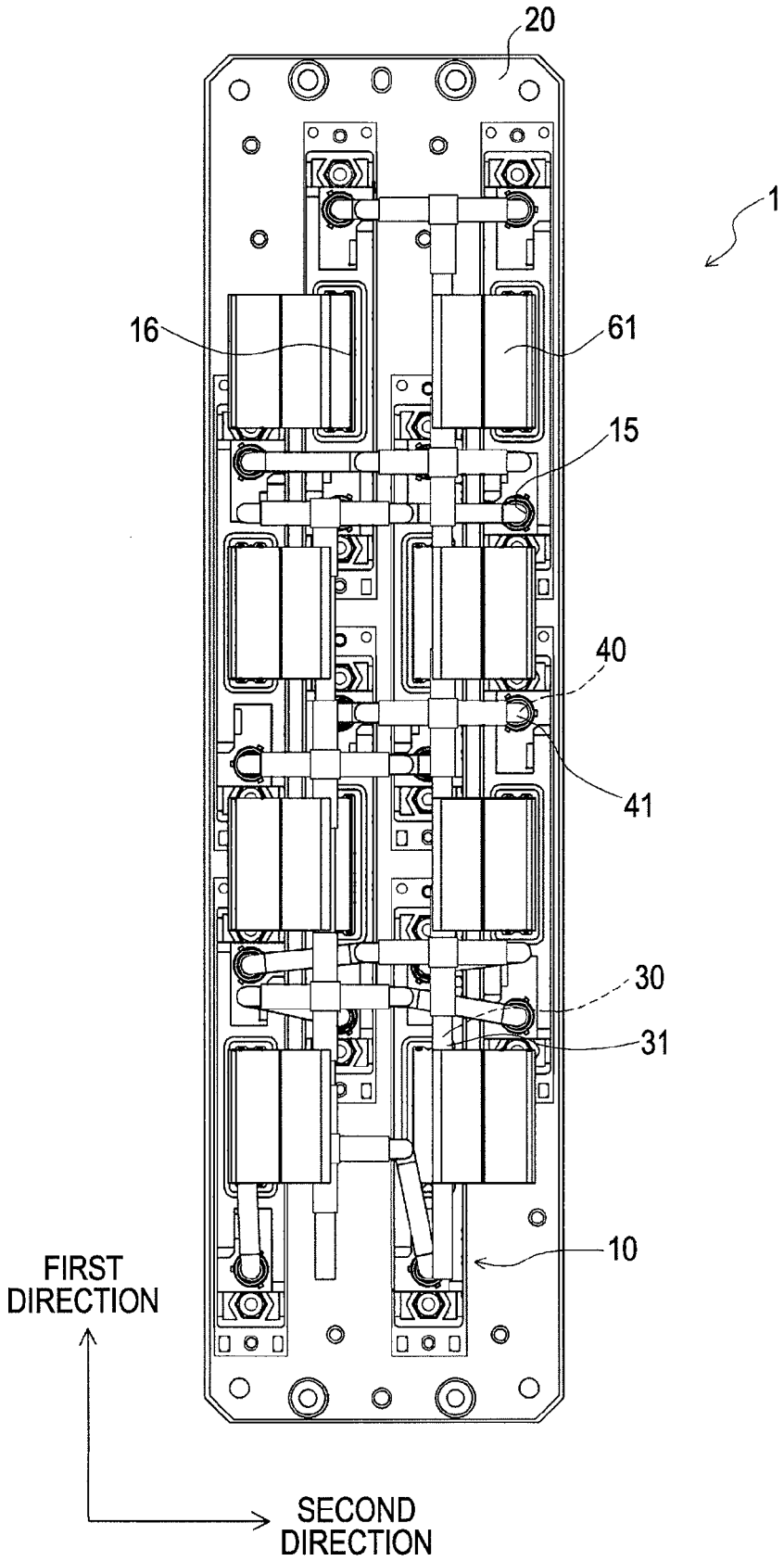
FIG. 4 is a top view showing a primary portion of the head unit according to the first embodiment of the invention.
Figure 5:
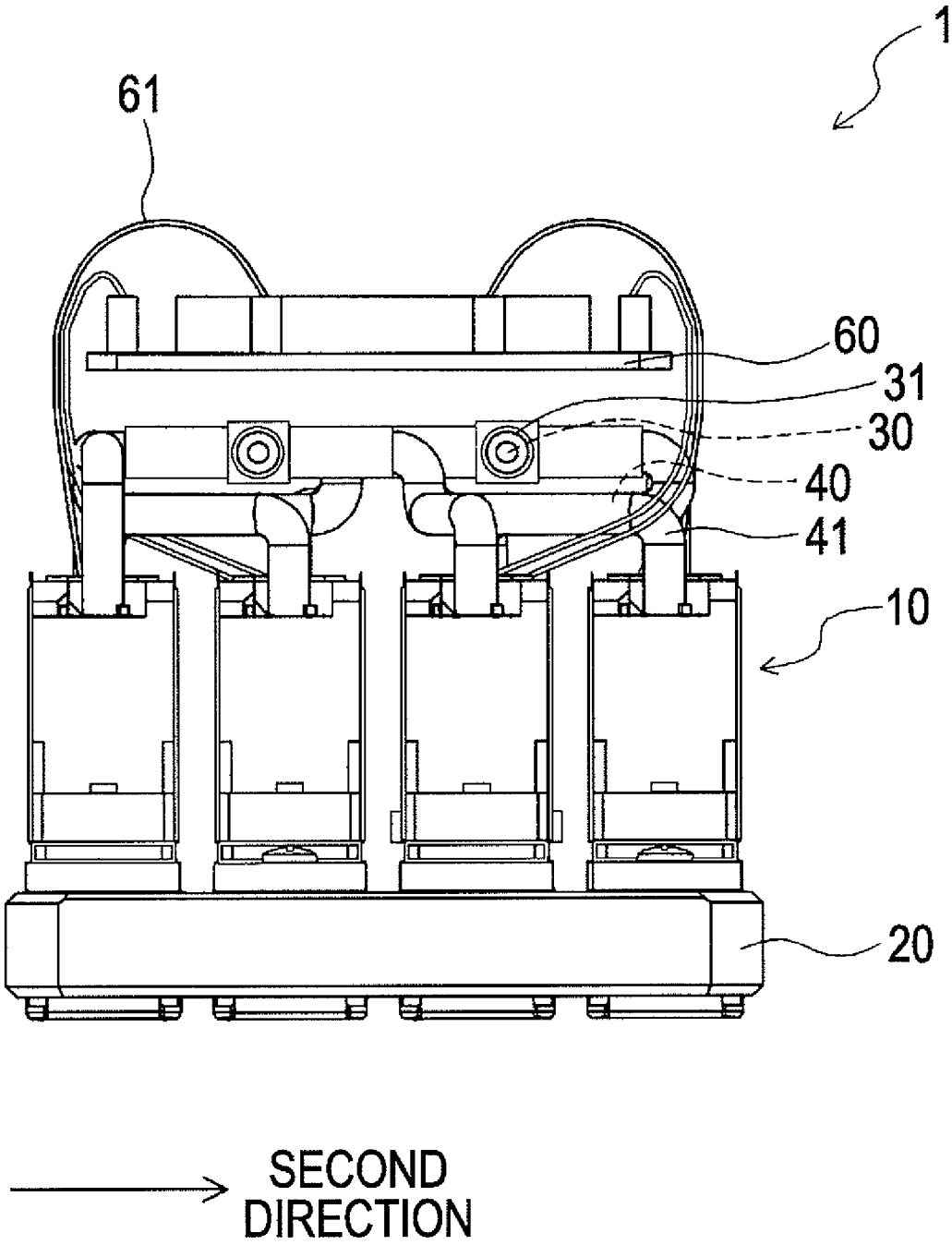
FIG. 5 is a front view showing the head unit according to the first embodiment of the invention.
Figure 6:
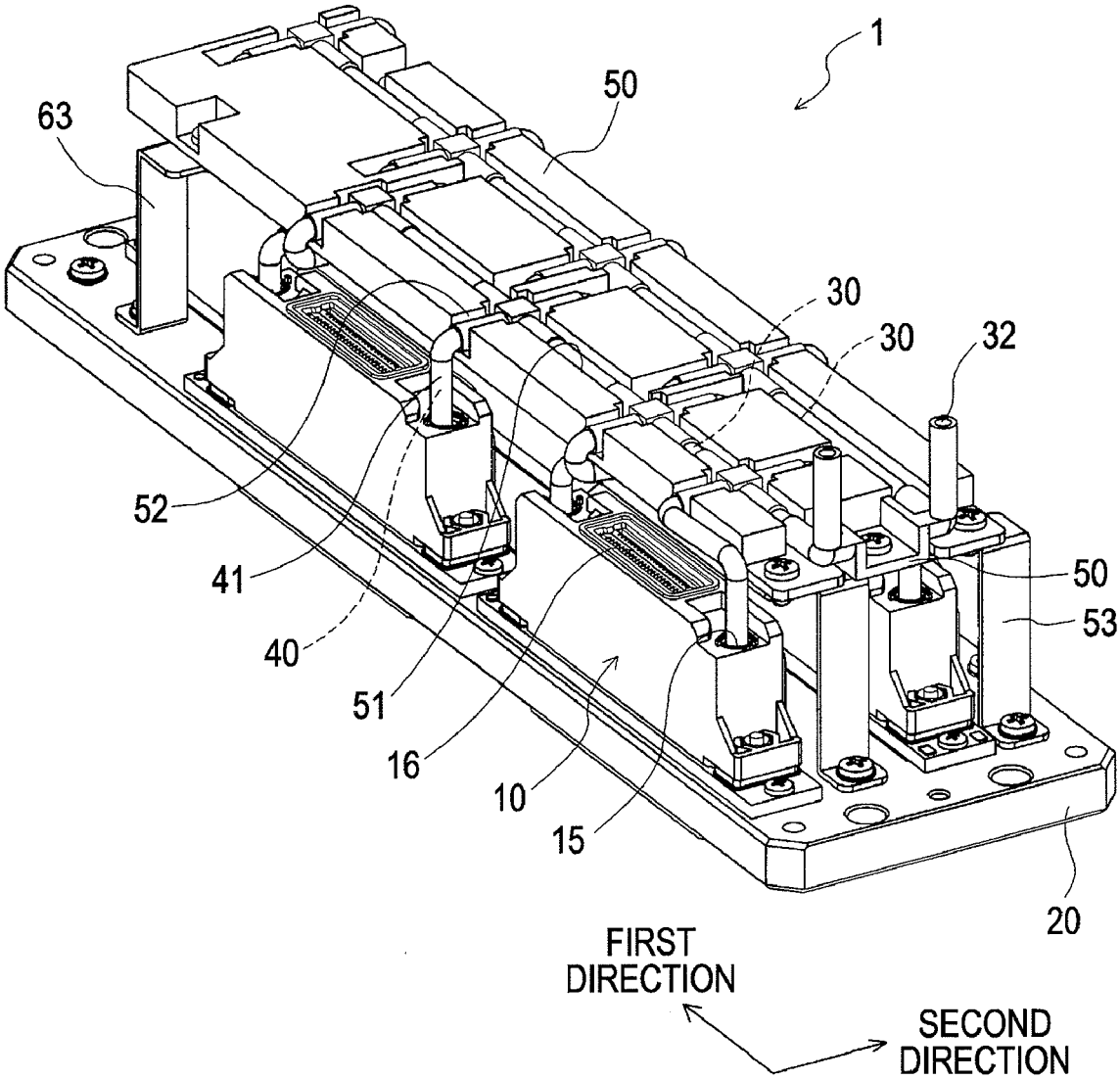
FIG. 6 is a perspective view showing a primary portion of the head unit according to the first embodiment of the invention.
Figure 7:
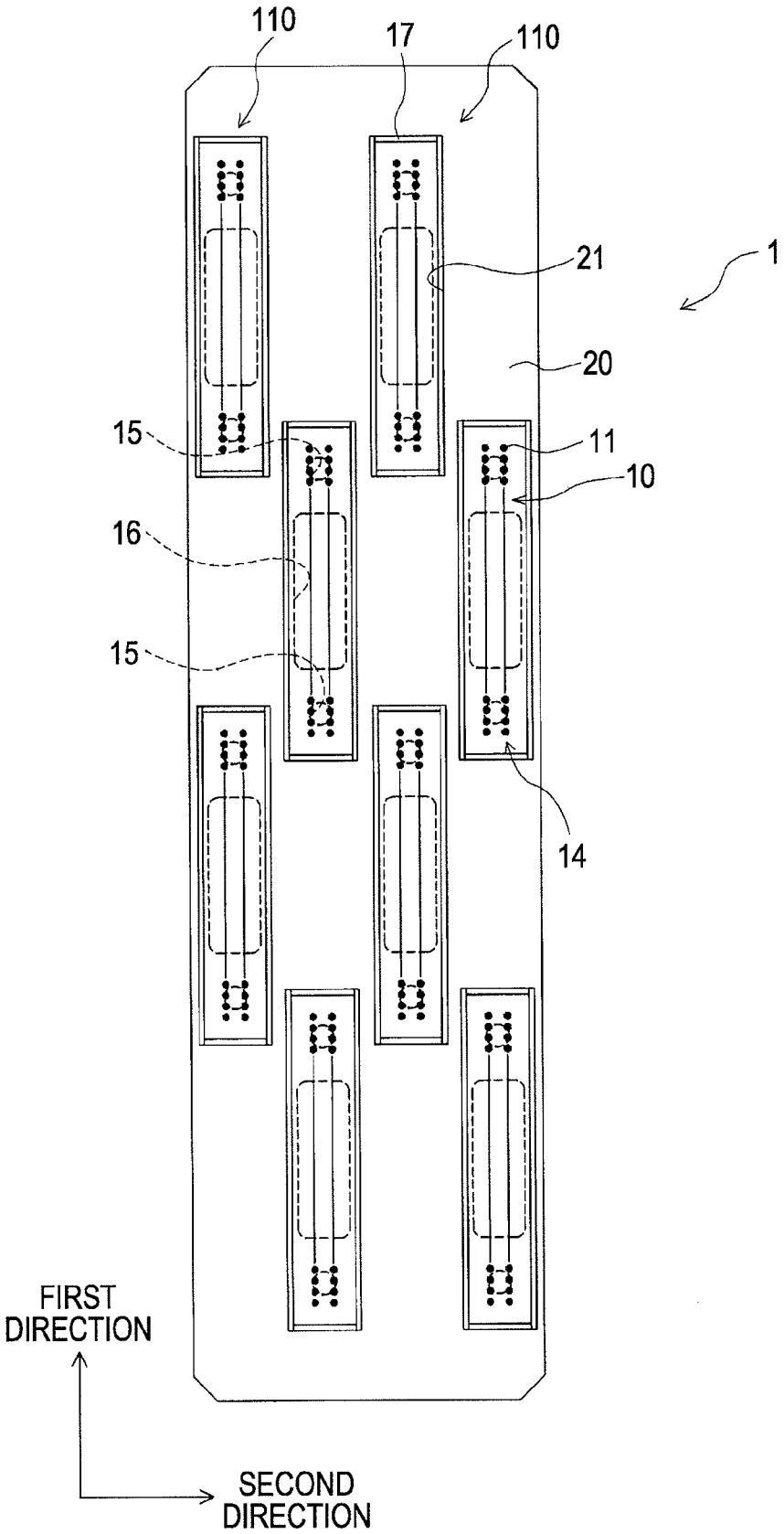
FIG. 7 is a bottom view showing the head unit according to the first embodiment of the invention.

The head 10 is mounted on an ink jet recording head unit 1 (hereinafter, also referred to as head unit). Herein, the detail of the head unit according to this embodiment is described. FIG. 3 is a perspective view showing an ink jet recording head unit which is an example of a liquid ejecting head unit according to the first embodiment of the invention. FIG. 4 is a top view showing the head unit with some components removed. FIG. 5 is a front view of FIG. 3. FIG. 6 is a perspective view showing the head unit with some components removed. FIG. 7 is a bottom view showing the head unit when viewed from the nozzle openings.

Referring to FIG. 3, the head unit 1 of this embodiment includes a plurality of heads 10, a common platform 20 on which the plurality of heads 10 are mounted, a trunk passage 30 provided above the platform 20, and a trunk circuit substrate 60 provided at a position opposite to the platform 20 with respect to the trunk passage 30.

Referring to FIG. 7, the platform 20 is a plate member made of metal, resin, etc. The platform 20 has holding holes 21 to which portions of the heads 10 at the nozzle arrays 14 are inserted. Each holding hole 21 of the platform 20 is slightly larger than the outer periphery of each head 10 at the nozzle arrays 14, but is smaller than the head 10 at the flange portions 17. Referring to FIGS. 5 and 6, the head 10 is held by the platform 20 such that the flange portions 17 are fixed to the periphery of the holding hole 21 while the portion of the head 10 at the nozzle arrays 14 is inserted into the holding hole 21. A space is provided between the head 10 and the holding hole 21. With the space, the head 10 is slightly movable in the first and second directions relative to the platform 20. The plurality of heads 10 are held by the platform 20 in a state where the nozzle arrays 14 are mutually positioned.

In this embodiment, four heads 10 are arranged in the first direction, in which the nozzle openings 11 are arranged in the nozzle array 14 of the head 10, and the four heads 10 define a head group 110. Two head groups 110 are arranged in parallel to the second direction. That is, a plurality of heads 10 are arranged in the first and second directions.

In particular, referring to FIG. 7, the plurality of heads 10 are arranged in a staggered manner in the first direction such that the nozzle arrays 14 are continuously arranged in the first direction. The two head groups 110, each of which includes the plurality of heads 10 arranged such that the nozzle arrays 14 are continuously arranged in the first direction, are arranged in parallel to the second direction. Herein, the first direction represents the direction in which the nozzle openings 11 are arranged in a line to define the nozzle array 14. The second direction represents the direction orthogonal to the first direction.

The continuous arrangement of the nozzle arrays 14 in the first direction of each head group 110 represents that, regarding heads 10 adjacent to each other in the second direction of the head group 110, the nozzle openings 11 at an end portion of the nozzle arrays 14 of one head 10 are located at equivalent positions to the positions of the nozzle openings 11 at an end portion of nozzle arrays 14 of the other head 10 in the first direction.

As described above, in each head group 110, since the nozzle arrays 14 of the plurality of heads 10 are continuously arranged in the first direction, printing in a wide range can be performed at a high speed as compared with a case in which nozzle arrays 14 of a single head 10 performs printing.

As described above, in this embodiment, the two head groups 110 are arranged in parallel along the second direction, each head group 110 including the four heads 10 arranged in a staggered manner in the first direction. Thus, the head unit 1 includes four groups of the nozzle arrays 14 continuously arranged in the first direction.

Also, since the heads 10 of each head group 110 are arranged in a staggered manner, referring to FIGS. 4 and 7, regarding the heads 10 being adjacent to each other in the second direction of each head group 110, the liquid passage ports 15 and the connectors 16 of the heads 10 are respectively arranged at different positions in the first direction. In particular, regarding the heads 10 being adjacent to each other in the second direction of each head group 110, the liquid passage ports 15 and the connector 16 of the one head 10 are arranged at positions different from the positions of the liquid passage ports 15 and the connector 16 of the other head 10 in the first direction. In other words, regarding a first head 10 and a second head 10, with the second head 10 being closest to the first head 10 from among the heads 10 whose projections are overlapped with a projection of the first head 10 in the second direction, a projection of the liquid passage port 15 of the first head 10 is not overlapped with a projection of the liquid passage port 15 of the corresponding second head 10 in the second direction. Also, a projection of the connector 16 of the first head 10 is not overlapped with a projection of the connector 16 of the corresponding second head 10 in the second direction. As described above, in the head 10 of this embodiment, the liquid passage ports 15 and the connector 16 are located within the length of the nozzle arrays 14. Regarding the heads 10 adjacent to each other in the second direction, the nozzle openings 11 at the end portion of the nozzle arrays 14 of the one head 10, and the nozzle openings 11 at the end portion of the nozzle arrays 14 of the other head 10, are arranged at equivalent positions in the first direction. Accordingly, the liquid passage ports 15 and the connector 16 of the one head (first head) 10 of the adjacent heads 10 (first and second heads 10) are arranged at positions different from the positions of the liquid passage ports 15 and the connector 16 of the other head (second head) 10 in the first direction. That is, the liquid passage ports 15 and the connector 16 of each head 10 is positioned with respect to the nozzle arrays 14 serving as a reference for positioning of the plurality of heads 10, such that the liquid passage ports 15 and the connector 16 of the one of the adjacent heads 10 in the second direction are arranged at positions different from the positions of the liquid passage ports 15 and the connector 16 of the other in the first direction. That is, in this embodiment, when projection is performed in the second direction, the fluid passage port 15 of the first head 10 is not overlapped with the fluid passage port 15 or the connector 16 of the corresponding second head 10. In addition, the liquid passage port 15 of the first head 10 is located between the liquid passage port 15 and the connector 16 of the corresponding second head 10.

Referring to FIGS. 4 and 6, a trunk passage member 31 having a common trunk passage 30 is continuously provided for the plurality of heads 10 in the first direction. The trunk passage member 31 is positioned above the platform 20 at a position opposite to the nozzle arrays 14. The trunk passage member 31 is positioned such that the trunk passage 30 extends in the first direction. The trunk passage 30 is connected to the liquid passage ports 15 of the plurality of heads 10 through branch passage members 41 including individual branch passages 40.

The trunk passage member 31 is a tube member made of metal, resin, etc. The trunk passage 30 is provided in the trunk passage member 31. The trunk passage member 31 is continuously positioned in the first direction so as to face the plurality of heads 10. In this embodiment, two trunk passage members 31 are arranged parallel along the second direction. The two trunk passage members 31 each have a connecting hole 32 at an end portion in the first direction. An externally provided reservoir section, such as an ink cartridge or an ink tank, is connected to the connecting hole 32.

The branch passage member 41 is a flexible tube made of a flexible material, such as rubber or resin. The branch passage 40 is provided in the branch passage member 41. One end portion of the branch passage member 41 is connected to the trunk passage member 31, and the other end portion is connected to the liquid passage port 15 of the head 10. Thus, the trunk passage 30 communicates with the liquid passage port 15 via the branch passage 40. The inside of the trunk passage member 31 may also serve as a branch passage portion which is split into sections corresponding to the heads 10 to supply ink to the heads 10. The branch passage portion may be directly connected to the liquid passage ports 15 of the heads 10.

A plurality of branch passage members 41 are provided respectively for the liquid passage ports 15. In this embodiment, eight heads 10, each having two liquid passage ports 15, are mounted on the platform 20. Hence, sixteen branch passage members 41 (branch passages 40) in total are provided. Eight branch passage members 41 are connected to a single trunk passage member 31. In this embodiment, since the branch passage members 41 of flexible tubes are used, the branch passage members 41 can be easily connected to the liquid passage ports 15 of the heads 10 which are mutually positioned. If a branch passage member 41 is made of a material such as a metal tube, which is not elastically deformable, the relative positions of a plurality of heads 10 of a head unit 1 cannot be completely equivalent to those of another head unit 1 due to, for example, dimensional tolerance of components. It may be difficult to connect the head 10 with the branch passage member 41. Thus, the branch passage member 41 may be preferably made of a material with a certain level of elasticity which can compensate for dimensional tolerances.

The trunk passage 30 functions as a common passage for the plurality of heads 10. The branch passage 40 functions as an individual passage provided for each of the liquid passage ports 15 of the head 10. That is, the trunk passage 30 and the branch passage 40 function as external passages connected to the above-described passages in the heads 10.

The two trunk passages 30 arranged in parallel along the second direction may communicate respectively with the head groups 110. Alternatively, the two trunk passages 30 may be connected to the liquid passage ports 15 irrespective of the head groups 110. For example, when different inks are ejected from the head groups 110, the trunk passages 30 may respectively communicate with the head groups 110. When the same ink is ejected from the two head groups 110, the trunk passages 30 do not have to respectively communicate with the head groups 110.

In one embodiment, the branch passage members 41 (branch passage 40) are connected such that ink is supplied from the same trunk passage 30 to the liquid passage ports 15 located at equivalent positions in the first direction. One end portions of the branch passage members 41 are connected to the liquid passage ports 15 located at equivalent positions in the first direction. Other end portions of the branch passage members 41 are connected to the trunk passage member 31 at equivalent positions in the first direction. That is, the liquid passage ports 15 of the two head groups 110 are located at the equivalent positions in the first direction. The liquid passage ports 15 of the single head group 110 are arranged at the different positions in the first direction. Accordingly, connection from the one trunk passage 30 to the liquid passage ports 15 is not overlapped with connection from the other trunk passage 30 to the liquid passage ports 15. Also, in one embodiment, since the two head groups 110 are provided, no more than two liquid passage ports 15 are arranged at the equivalent positions in the first direction in all heads 10. The branch passages 40 may extend to both sides in the second direction of the trunk passage 30 at the same position, and may be connected to the liquid passage ports 15 arranged at the equivalent positions in the first direction. Accordingly, for supply or discharge of the ink to or from the heads 10 arranged at equivalent positions in the first direction, the passages from the outside to the liquid passage ports 15 via the trunk passage 30 and the branch passages 40 may have equivalent lengths. To be more specific, the trunk passages 30, each of which has the two branch passage members 41 connected thereto, have equivalent lengths. Thus, by adjusting the lengths of the passages of the branch passages 40 which connect the trunk passages 30 with the liquid passage ports 15, the passages extending from the outside to the liquid passage ports 15 via the trunk passages 30 and the branch passages 40 may have equivalent lengths. Accordingly, in the heads 10 arranged at equivalent positions in the first direction, supply or discharge conditions, such as a pressure loss of ink, can be easily equalized, and thus, ink supply characteristic or ink discharge characteristic can be easily controlled.

Also, in this embodiment, the above-described trunk passage member 31 is held by a plate-shaped trunk passage holding member 50 as shown in FIGS. 3 and 6.

The trunk passage holding member 50 is a plate member and has a groove 51 in the surface of the trunk passage holding member 50. The groove 51 has a larger width than the outer diameter of the trunk passage member 31. Two grooves 51 are arranged in parallel along the second direction so as to continuously extend in the first direction. The trunk passage members 31 provided with the trunk passages 30 are respectively inserted into the grooves 51 and are held thereby. In addition, the grooves 51 have branch grooves 52 split at equivalent positions to the positions of the liquid passage ports 15 in the first direction. The branch passage members 41 provided with the branch passages 40 are partly inserted into the branch grooves 52 and are held thereby. The branch grooves 52 provided between the two grooves 51 have through holes (not shown) which penetrate through the plate member in the thickness direction. The branch passage members 41 are led to the heads 10 (the back surface) through the through holes.

The trunk passage holding member 50 is held by the platform 20 via a plurality of legs 53. The legs 53 have a larger height than the height of the heads 10 from the platform 20. Thus, a predetermined space is defined between the heads 10 and the trunk passage holding member 50 held by the legs 53. The branch passage members 41 are arranged in the space between the heads 10 and the trunk passage holding member 50. Also, a branch circuit wiring section 61 (described later in detail) is arranged in the space between the heads 10 and the trunk passage holding member 50.

Referring to FIGS. 3 and 5, a plate-shaped trunk circuit substrate 60 is provided at a position opposite to the platform 20 with respect to the trunk passage 30. The trunk circuit substrate 60 has a wiring pattern (not shown) on a surface.

Referring to FIG. 3, an external wiring section 70 is connected to an end portion in the first direction of the trunk circuit substrate 60. The trunk circuit substrate 60 is supplied with, for example, a printing signal from the outside, and an electric signal from a power source, through the external wiring section 70. The external wiring section 70 is connected to the end portion, opposite to the portion provided with the connecting holes 32 to which the reservoir sections of the trunk passage members 31 are connected, so that the external wiring section 70 does not interfere with the trunk passage members 31.

The trunk circuit substrate 60 is electrically connected to the connectors 16 of the heads 10 via a branch circuit wiring section 61 formed of flexible flat cables (FFC). Electric signals supplied from the external wiring section are supplied to the heads 10 via the trunk circuit substrate 60 and the branch circuit wiring section 61.

Herein, a plurality of branch circuit wiring sections 61 are provided, connected to the trunk circuit substrate 60 at both end portions of the trunk circuit substrate 60 in the second direction, and arranged in the first direction. The plurality of branch circuit wiring sections 61 provided at one end portion in the second direction of the trunk circuit substrate 60 are connected to the heads 10 of the one head group 110, whereas the plurality of branch circuit wiring sections 61 provided at the other end portion are connected to the heads 10 of the other head group 110. In other words, the branch circuit wiring sections 61 are arranged in the first direction at both end portions in the second direction of the trunk circuit substrate 60 such that the positions of the branch circuit wiring sections 61 correspond to the positions of the connectors 16 of the heads 10 of the head groups 110. The branch circuit wiring sections 61 are led from both sides in the second direction of the trunk circuit substrate 60 to the back surface via side surfaces where the space between the heads 10 and the trunk passage holding member 50 is exposed, and the branch circuit wiring sections 61 are connected to the heads 10.

Regarding a single head group 110, the connectors 16 are formed at positions opposite to liquid (ink) ejecting surfaces of the heads 10 as shown in FIGS. 3 and 4. This is to prevent mists, which are generated by the ink ejected from the heads 10, from adhering to the connectors 16. The connectors 16 are arranged at the positions different from the positions of the liquid passage ports 15 in the first direction. Thus, the branch circuit wiring sections 61 can be connected to the heads 10 without interfering with the branch passage members 41. In particular, regarding the single head group 110, the liquid passage ports 15 and the connectors 16 are not overlapped with each other in the second direction, and are arranged visibly in the first direction. Accordingly, the branch passage members 41 and the branch circuit wiring sections 61 connected to the heads 10 do not interfere with each other. Thus, the branch circuit wiring sections 61 do not have to be led in a complex manner. The branch circuit wiring sections 61 can be easily connected to the heads 10 by a small length.

As described above, the branch passage members 41 and the branch circuit wiring sections 61 can be easily connected to the heads 10, while the piping and wiring structures can be simplified. The head unit 1 can be reduced in size, erroneous connection can be prevented from occurring during assembling, and cost can be reduced by decreasing assembling time.

Referring to FIG. 3, the trunk circuit substrate 60 is fixed to the platform 20 via circuit legs 63 arranged at positions outside the trunk passage holding member 50. The circuit legs 63 have a larger height than the height of the trunk passage member 31. Thus, a predetermined space is defined between the trunk passage member 31 and the trunk circuit substrate 60. By arranging the trunk circuit substrate 60 at a position opposite to the platform 20 with respect to the trunk passage 30, the trunk circuit substrate 60 is located at a position farthest from the liquid (ink) ejecting surfaces of the heads 10. The mists, which are generated upon ink ejection, can be prevented from adhering to the trunk circuit substrate 60.

With the above-described head unit 1, the heads 10, the platform 20, the trunk passages 30, and the trunk circuit substrate 60 are fixed to each other and modularized (to be a composite part). Thus, the modularized head unit 1 can be used only by mounting the head unit 1 on the ink jet recording apparatus, connecting the reservoir sections, such as ink cartridges or ink tanks, to the trunk passages 30, and connecting the external wiring section 70 to the trunk circuit substrate 60.

Also, the head unit 1 of this embodiment is fixed to the apparatus body such that the second direction of the head unit 1 is aligned with a direction in which a recording medium, such as a recording sheet or a substrate, is transported in a liquid ejecting apparatus represented by an ink jet recording apparatus. Thus, the head unit 1 can be applied to a line recording apparatus which can perform recording only by transporting the recording medium in the second direction.

The liquid ejecting apparatus is not limited thereto. For example, the head unit 1 may be mounted on a movable section such as a carriage which is movable in a direction orthogonal to a transporting direction of a recording medium. Accordingly, printing can be performed on a recording medium with a larger width than the length of the nozzle arrays 14 continuously arranged in the first direction in the head group 110 of the head unit 1. That is, the head unit 1 is arranged such that the first direction is aligned with the transporting direction of the recording medium, so that printing is performed while the head unit 1 is moved in the second direction and the recording medium is moved in the first direction. Thus, printing can be performed on a relatively large recording medium.

The number of head units 1 mounted on the liquid ejecting apparatus is not particularly limited, and a plurality of head units 1 may be mounted on the liquid ejecting apparatus.

Figure 8:
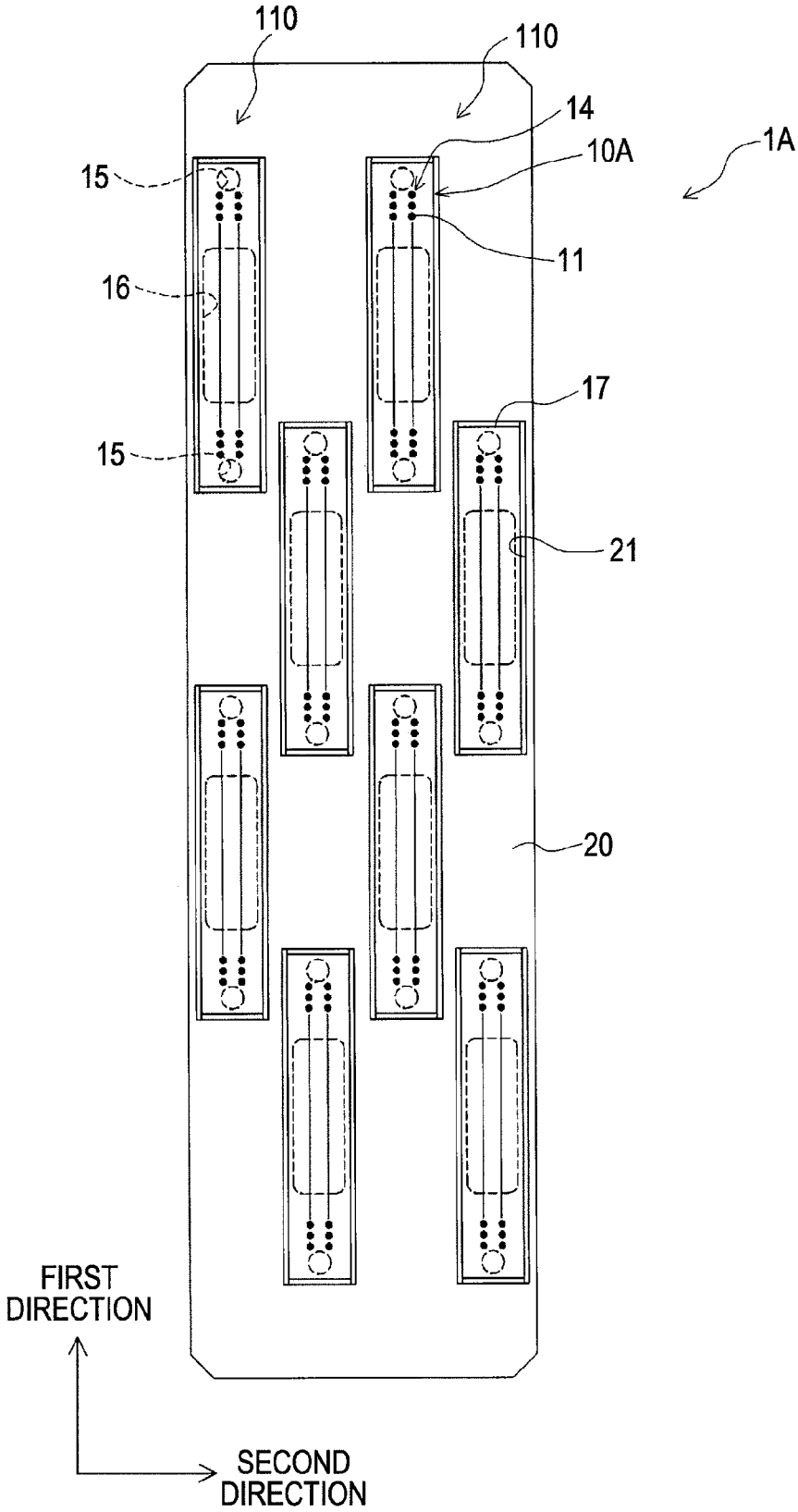
FIG. 8 is a bottom view showing a head unit according to a second embodiment of the invention.

FIG. 8 is a bottom view showing nozzle openings of a head unit, which serves as a liquid ejecting head unit according to another embodiment of the invention. Like reference characters refer like components similar to those in the above embodiment, and the redundant description will be omitted.

Referring to FIG. 8, heads 10A of a head unit 1A of this embodiment each include a connector 16 at a center portion in the first direction, and liquid passage ports 15 at positions outside the length of nozzle array 14.

The liquid passage ports 15 are positioned such that when the heads 10A are mounted on the platform 20, the liquid passage ports 15 of one head 10A, of the heads 10A being adjacent to each other in the second direction, are arranged at positions different from the positions of the liquid passage ports 15 and the connector 16 of the other head 10A in the head group 110. That is, the liquid passage ports 15 and the connector 16 of each head 10A is positioned with respect to the nozzle arrays 14, serving as a reference for positioning of the plurality of heads 10A, such that the liquid passage ports 15 and the connector 16, of the one of the adjacent heads 10A in the second direction, are arranged at positions different from the positions of the liquid passage ports 15 and the connector 16 of the other of the adjacent heads 10A.

Even with the head unit 1A, similarly to the first embodiment 1, the branch passage members 41 and the branch circuit wiring sections 61 can be easily led and easily connected to the heads 10A. Accordingly, the head unit 1A can be reduced in size, erroneous connection during assembling can be prevented from occurring, and the cost can be reduced by decreasing the assembling time.

While the embodiments of the invention have been described above, the basic structure of the invention is not limited to those described above.

In the embodiments herein, the two nozzle arrays 14 are provided at the head 10, 10A, however, it is not limited thereto. For example, a single nozzle array 14, or three or more nozzle arrays 14 may be provided at the head 10, 10A.

Also, in the embodiments herein, the head group 110 includes the four heads 10, 10A, however, it is not limited thereto. The head group 110 may include at least two heads 10, 10A.

Further, in the embodiments herein, the head unit 1, 1A includes the two head groups 110, however, it is not limited thereto. The head group 110 may include a single head unit 1, 1A, or three or more head units 1, 1A. It is to be noted that if a single head unit 1, 1A includes three or more head groups 110, the number of liquid passage ports 15 or connectors 16 which are arranged at equivalent positions in the second direction become three or more. When the number of the head groups 110 is increased, the arrangement of the branch passage members 41 and the branch circuit wiring sections 61 may become complicated.

Also, in the embodiments herein, the first direction is the arrangement direction of the nozzle openings of the head 10, 10A, and the second direction is the direction orthogonal to the arrangement direction of the nozzle openings, however, the first direction may be defined by a direction in which the trunk passage extends, and the first direction does not have to be aligned with the arrangement direction of the nozzle openings. That is, the trunk passage may be provided to extend in a direction orthogonal to the arrangement direction of the nozzle openings.

Further, in the embodiments herein, when projection is performed in the second direction, the liquid passage ports 15 of the first head 10, 10A are not overlapped with the liquid passage ports 15 or the connector 16 of the second head 10, 10A, and the liquid passage port 15 of the first head 10, 10A is arranged at a position between the liquid passage port 15 and the connector 16 of the second head 10, 10A, however, it is not limited thereto. For example, when projection is performed in the second direction, the liquid passage port 15 of the first head 10, 10A may be arranged at a position overlapped with the connector 16 of the corresponding second head 10, 10A. It is to be noted that, with such a structure, the branch passage member 41 connected to the liquid passage port 15 may interfere with the branch circuit wiring section 61 connected to the connector 16. That is, with the structure according to any of the embodiments herein, interference between the branch passage member 41 connected to the liquid passage port 15 and the branch circuit wiring section 61 connected to the connector 16 can be reliably prevented. Also, the liquid passage port 15 of the first head 10, 10A may be overlapped at a position other than the position between the liquid passage port 15 and the connector 16 of the second head 10, 10A. It is to be noted that with such a structure, the head unit 1, 1A may be increased in size. In contrast, with the structure according to any of the embodiments herein, the head unit 1, 1A can be reduced in size.

Also, in the embodiments herein, the liquid passage port 15 and the connector 16 are provided at a back surface opposite to the surface provided with the nozzle openings 11 of the head 10, 10A, however, it is not limited thereto. For example, one or both of the liquid passage port 15 and the connector 16 may be provided at a side surface of the head 10, 10A.

Further, for example, when the two liquid passage ports 15 are provided at the single head 10, 10A, and the one liquid passage port 15 serves as the liquid supply port for supplying ink (liquid) to the head 10, 10A while the other liquid passage port 15 serves as the liquid discharge port for discharging ink (liquid) from the head 10, 10A. Like the embodiments herein, the liquid passage ports 15 of a plurality of heads 10 close to each other in the first direction may serve as the liquid supply ports or the liquid discharge ports. That is, by arranging the liquid supply ports and the liquid discharge ports so as to be close to each other in the first direction, the supply characteristic or the discharge characteristic, from or to the external reservoir section, of the heads 10 close to each other in the first direction can be equalized, and ejecting characteristic of liquid can be equalized.

Figure 9:
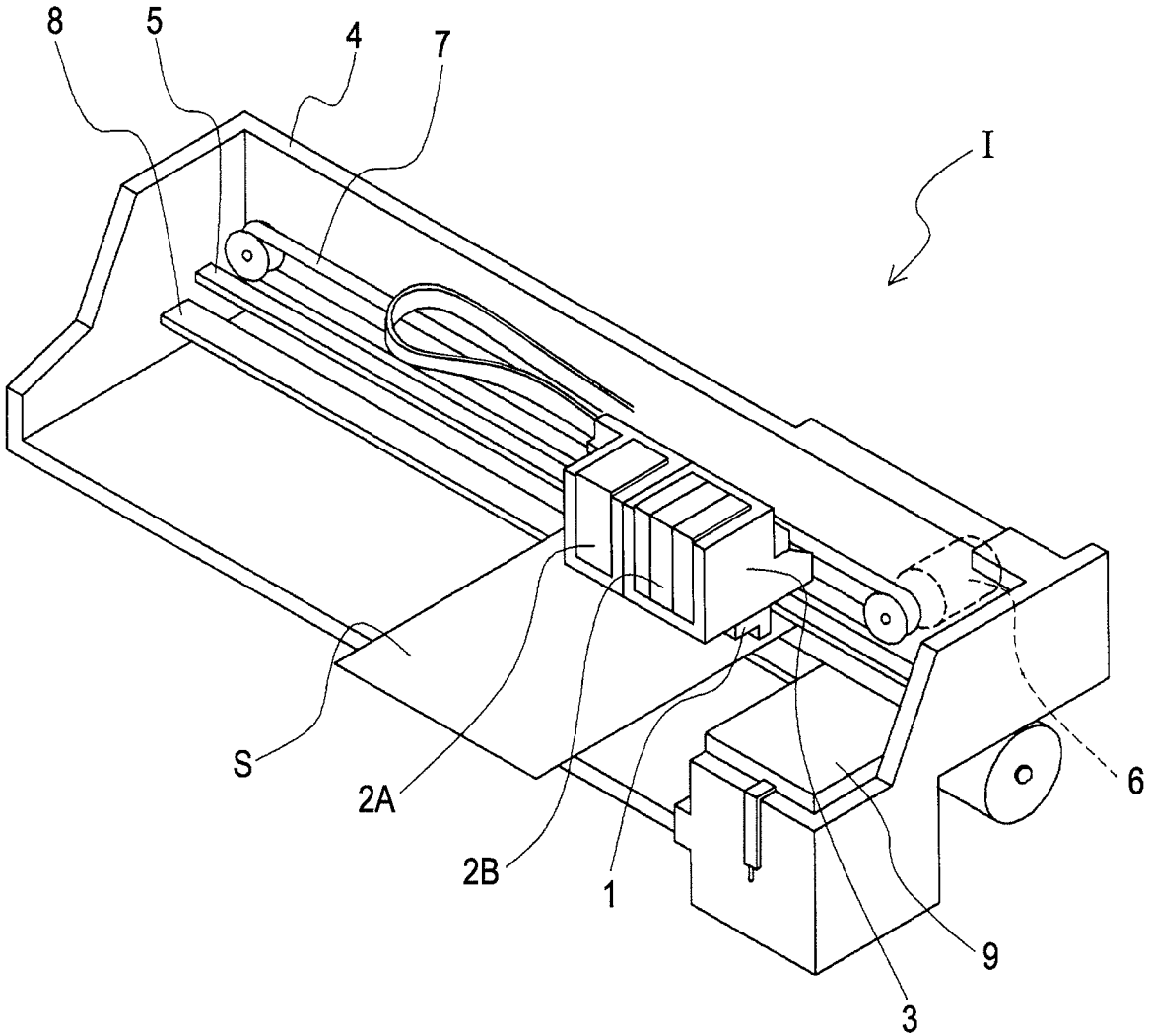
FIG. 9 is a perspective view showing a recording apparatus according to an embodiment of the invention.

The head unit 1, 1A of the embodiments is mounted on an ink jet recording apparatus. FIG. 9 is a schematic illustration showing an example of the ink jet recording apparatus.

In an ink jet recording apparatus I shown in FIG. 9, two head units 1 are provided, and cartridges 2A and 2B are detachably attached on the head units 1. The cartridges 2A and 2B serve as ink supply sections. The two head units 1 are mounted on a carriage 3. The carriage 3 is provided at a carriage shaft 5 axially movably. The carriage shaft 5 is attached to an apparatus body 4. For example, the two head units 1 eject a black ink composition and a color ink composition.

A driving force of a driving motor 6 is transmitted to the carriage 3 via a plurality of gears (not shown) and a timing belt 7. Accordingly, the carriage 3 with the head units 1 mounted is moved along the carriage shaft 5. Also, a platen 8 is provided at the apparatus body 4 and extend along the carriage shaft 5. A recording sheet S, which is a recording medium such as paper fed by a sheet feed roller (not shown), is transported on the platen 8.

In the above-described ink jet recording apparatus I, the head units 1 are mounted on the carriage 3 and moved in a main-scanning direction; however, it is not limited thereto. For example, the invention can be applied to a line recording apparatus in which the head units 1, 1A are fixed, and printing is performed only by moving a recording sheet S in a sub-scanning direction.

Further, the invention may be applied to wide varieties of liquid ejecting head units on which liquid ejecting heads are mounted. For example, the invention may be applied to various types of ink jet recording head units used for image recording apparatuses such as a printer, color-material ejecting head units used for manufacturing color filters of liquid crystal displays etc., electrode-material ejecting head units used for forming electrodes of organic EL displays, field emission displays (FED), etc., and living-organic-material ejecting head units used for manufacturing biochips. The ink jet ejecting apparatus I has been explained as an example of the liquid ejecting apparatus; however, the liquid ejecting apparatus may be any type of liquid ejecting apparatuses, such as an image recording apparatus, a color filter manufacturing apparatus, and an electrode forming apparatus, in which the above-mentioned liquid ejecting head units are mounted.

What is claimed is:

1. A liquid ejecting head unit, comprising:

a plurality of liquid ejecting heads, each including: a nozzle array in which a plurality of nozzle openings are arranged in a first direction, a liquid passage port with an open inner passage and to which an external passage is connected, and a connector to which an electric signal is supplied;

a platform on which the plurality of the liquid ejecting heads are mounted in the first direction and a second direction which is orthogonal to the first direction;

a common trunk passage communicating with the liquid passage ports, the common trunk passage extending in the first direction;

a plurality of branch passages communicating with the trunk passage, and respectively communicating with the liquid passage ports; and a plurality of branch circuit wiring sections connected to the connectors of the liquid ejecting heads, the branch circuit wiring sections supplying the electric signals to the liquid ejecting heads, wherein the plurality of liquid ejecting heads are mounted such that the liquid passage ports of each partially adjacent liquid ejecting head are not adjacent to each other in the second direction, and such that the connectors of each partially adjacent liquid ejecting head are not adjacent to each other in the second direction.

2. The liquid ejecting head unit according to claim 1, wherein, the liquid passage ports and connectors of each partially adjacent liquid ejecting head are not adjacent to each other in the second direction.

3. The liquid ejecting head unit according to claim 2, wherein, the liquid passage port of each liquid ejecting head is adjacently located in the second direction between the liquid passage port and the connector of a partially adjacent liquid ejecting head.

4. The liquid ejecting head unit according to claim 1, further comprising a common trunk circuit substrate positioned parallel to the platform with trunk passage lying therebetween, the trunk circuit substrate supplying the electric signals to the branch circuit wiring sections.

5. The liquid ejecting head unit according to claim 1, wherein the liquid passage port is arranged within a length of the nozzle array.

6. The liquid ejecting head unit according to claim 1, wherein the connector and the liquid passage port overlap with the nozzle array in a vertical direction orthangonal to the first and second directions.

7. The liquid ejecting head unit according to claim 1, wherein the liquid passage port is arranged outside a length of the nozzle array.

8. The liquid ejecting head unit according to claim 1, wherein the connector and the plurality of liquid passage ports are arranged in a line in the first direction.

9. The liquid ejecting head unit according to claim 1, wherein liquid passage ports of the plurality of liquid ejecting heads are linerally arranged in the first direction.

10. The liquid ejecting head unit according to claim 1, wherein each liquid ejecting head includes two liquid passage ports, and wherein one of the liquid passage ports of each liquid ejecting head serves as a liquid supply port for supplying liquid to a passage in each liquid ejecting head, and the other liquid passage port serves as the liquid supply port or a liquid discharge port for discharging liquid from the liquid ejecting head.

11. A liquid ejecting apparatus, comprising:

the liquid ejecting head unit according to claim 1, wherein liquid is ejected from the nozzle openings.

12. A liquid ejecting head unit, comprising:

a platform with a top side and a bottom side, the platform including mounting holes staggered along a first direction, with only portion of the mounting holes being directly adjacent to each other along a second direction, the second direction orthogonal to the first direction;

a plurality of liquid ejecting heads, each with an end surface and a passage surface which is opposite to the end surface, with respect to the top side and a bottom side, each liquid ejecting head inserted in a respective mounting hole with the end surface viewable from the bottom side, each liquid ejecting head including: at least one nozzle array on the end surface linearly arranged along the first direction, at least one liquid passage port on the passage surface, and at least one connector on the passage surface;

wherein only a portion of the liquid ejecting heads are directly adjacent to each other along the second direction, and wherein the liquid passage ports and nozzle arrays are located within directly adjacent portions, and the connectors are not located within directly adjacent portions, and wherein the liquid passage ports are not directly adjacent to each other.

13. The liquid ejecting head unit according to claim 12, further comprising a first trunk passage coupled to the liquid passage ports of a first group of non-directly adjacent liquid ejecting heads, and a second trunk passage coupled to the liquid passage ports of a second group of non-directly adjacent liquid ejecting heads, each common trunk passage linearly extending in the first direction.

14. The liquid ejecting head unit according to claim 13, wherein a plurality of branch passages couples the trunk passages to the liquid passage ports of the liquid ejecting heads.

15. The liquid ejecting head unit according to claim 14, additionally comprising a plurality of branch circuit wiring sections connected to the connectors of the liquid ejecting heads, each branch circuit wiring sections located between a pair of branch passages along the first direction.

16. The liquid ejecting head unit according to claim 12, wherein the at least one nozzle array comprises two nozzle arrays which are located on different sides of the end surface.

17. The liquid ejecting head unit according to claim 16, wherein the at least one liquid passage port comprises two liquid passage ports which are located on different sides of the passage surface.

18. The liquid ejecting head unit according to claim 17, wherein each liquid passage port is directly opposite to a nozzle array, with respect to the top side and a bottom side.

19. The liquid ejecting head unit according to claim 17, wherein each liquid passage port is not directly opposite to a nozzle array, with respect to the top side and a bottom side.

20. The liquid ejecting head unit according to claim 17, wherein the connector is located between the two liquid passage ports.

* * * * *